United States Patent [19]

Maasberg

[11] 3,998,387

[45] Dec. 21, 1976

[54] APPARATUS FOR TREATING A SURFACE WITH A LIQUID

[75] Inventor: Wolfgang Maasberg, Post Drevenack, Germany

[73] Assignee: Woma-Apparatebau Wolfgang Maasberg & Co. GmbH, Duisburg, Germany

[22] Filed: Oct. 23, 1975

[21] Appl. No.: 625,093

[30] Foreign Application Priority Data

Oct. 24, 1974 Germany ..... 2450510

[52] U.S. Cl. ..... 239/102; 15/354; 118/323; 134/172; 134/183; 239/161; 239/287; 239/499

[51] Int. Cl.[2] ..... B05B 3/14; B08B 3/02; B63B 59/00

[58] Field of Search ..... 134/172, 182, 183, 24, 134/34; 239/102, 161, 166, 287, 288–288.5, 499, DIG. 7, 505, 507, 518; 118/305, 313, 314, 323; 114/222; 15/306 R, 320, 354, 405

[56] References Cited

UNITED STATES PATENTS

| | | | |
|---|---|---|---|
| 2,895,680 | 7/1959 | Tavone | 239/161 X |
| 3,390,835 | 7/1968 | Harris | 239/102 X |
| 3,609,916 | 10/1971 | Hammelmann | 118/305 UX |
| 3,726,481 | 4/1973 | Foster et al. | 239/287 |
| 3,877,643 | 4/1975 | Smith et al. | 239/102 |

FOREIGN PATENTS OR APPLICATIONS

| | | | |
|---|---|---|---|
| 493,723 | 6/1953 | Canada | 239/DIG. 7 |

*Primary Examiner*—Johnny D. Cherry
*Assistant Examiner*—Andres Kashnikow
*Attorney, Agent, or Firm*—Karl F. Ross; Herbert Dubno

[57] ABSTRACT

An apparatus for treating a surface with a liquid has a support displaceable over the surface and carrying a spray beam itself provided with a plurality of nozzles directed at the surface. A diffuser surrounds a plurality of the nozzles and has a deflector for diverting the streams of liquid emitted by the nozzles so that these streams flow in a direction generally parallel to the surface being treated. Rollers maintain the front face of the deflector a predetermined distance from the surface being treated. The spray beam may be in two sections which are oppositely reciprocated to increase the treatment effect.

12 Claims, 8 Drawing Figures

APPARATUS FOR TREATING A SURFACE WITH A LIQUID

CROSS-REFERENCE TO RELATED APPLICATION

This application is related to my copending and concurrently filed patent application Ser. No. 625,094.

FIELD OF THE INVENTION

The present invention relates to an apparatus for treating a surface with a liquid. More particularly this invention concerns a device for treating or cleaning walls, floors, ceilings and similar surfaces by spraying against such surfaces liquid from a plurality of nozzles carried on a spray beam.

BACKGROUND OF THE INVENTION

The use of a spray is known for street-cleaning purposes. The many spray nozzles on the beam are directed at the surface to be cleaned so as to loosen and wash away dirt thereon. The greater pressure and flow the greater is the cleaning and rinsing effect. As these two parameters grow, however, the reaction force against the spray beam also increases. It is therefore necessary to make the support for the sprayer beam very robust in order to compensate for these high pressures. In addition, it is necessary to support the sprayer beam on the surface relatively close to the washing location. When cleaning a wall or ceiling surface the problem is compounded considerably as it is necessary to provide a massive support and holding arrangement.

OBJECTS OF THE INVENTION

It is therefore an object of the present invention to provide an improved washing apparatus of the spray beam type.

Another object is the provision of such a device wherein the reaction force of the liquid issuing from the nozzles is fully compensated for.

SUMMARY OF THE INVENTION

These objects are attained according to the present invention in an apparatus for treating a surface with a liquid which has a support displaceable over the surface, a spray beam on the surface, a plurality of nozzles on the beam directed at the surface, and means for supplying liquid to the nozzles and directing a stream of this liquid from each nozzle toward the surface. Means is provided on the support for maintaining the nozzles a predetermined distance from the surface and a diffuser surrounds at least one of the nozzles and has a deflector surface for diverting the respective stream of the liquid flow in a direction generally parallel to the surface being cleaned. Such deflection of the water stream or streams completely eliminates the reaction force normally urging the cleaning device away from the surface it is acting on. This compensation is effective both under water and in the air, with a greater distance between the diverting flange and the surface under treatment being employed under water than in the air. When used under water bubbles formed by cavitation serve to greatly increase the cleaning effect of the liquid stream being passed over the surface being cleaned.

With the system according to the present invention, not only is the reaction force of the spray beam compensated for fully but, indeed, even an adhering effect that is a component of force effective to hold the apparatus on the surface, is created according to the so-called hydrodynamic paradox. This is true because the flow velocity of the secondary stream of the sprayed liquid between the diverting flange and the surface being treated is so high that the static pressure in this region is smaller than that which is effective on the flange from outside, this latter pressure being equal to the static pressure in the surrounding water or the surrounding air. Thus the diffuser or diverting flange and, therefore, the spray beam are drawn toward the surface with a force dependent on the pressure/volume ratio of the water stream or streams and the surface area of the diffuser turned toward the surface being treated. In addition the diffuser is, jet-pump fashion, partially evacuated by water flowing due to the Coanda effect over the inside of the diverting flange. The liquid stream is induced to flow along the inside surface of the diffuser and be deflected thereby laterally outwardly due to the Coanda effect and, at the location between the primary stream flowing toward the surface being cleaned and the secondary stream flowing parallel thereto, the change in direction is effective like a jet-pump to evacuate the interior of the diffuser and to draw the arrangement toward the surface being cleaned. See p. 244 of *Introduction to Mechanics and Heat*, by N. Frank (McGraw-Hill, 1939) for a discussion of the physical principles involved.

With the system according to the present invention a liquid cushion is created between the front face of the cleaning apparatus and the surface being cleaned so that this cleaning apparatus may be displaced with virtually no friction over the surface being cleaned. Only negligible fluid friction is present.

According to further features of this invention the diffuser surrounding each of the spray nozzles or surrounding all of the spray nozzles is formed as a flat plate. It is also possible to form the diffuser as a cylindrical body with a bottom or end surface surrounding the spray nozzle and a lip at the other end constituting the diverting flange. Further according to the invention the diffuser is generally funnel-shaped and has an outer lip forming the diverting flange. Such a funnel-shaped diffuser may be of hyperbolic section. In any case the diffuser is effective to decrease the flow speed in the direction of flow and thereby increase the pressure and thereafter to increase the speed and decrease the pressure so that finally the static pressure effective from outside on the diffuser and its lip acts as a reaction compensation force and serves to hold the apparatus in place on the surface being cleaned.

According to further features of this invention, adjustable spacers are provided for holding the apparatus a predetermined variable distance from the surface being cleaned. Such spacers may comprise rollers or wheels which prevent the spray beam from approaching the surface being cleaned too closely and which insure good fluid flow over the surface being cleaned.

In accordance with further features of this invention the spray nozzles are spaced apart by a predetermined distance along the spray beam. The spray beam in accordance with the invention is formed of a pair of sections limitedly displaceable relative to each other and together forming a vibratory system provided with a mechanical actuator, with a spring separating the two beam sections. Thus the beam sections can be displaced oppositely oscillatingly relative to one another so as greatly to increase the cleaning effect. The actuator serving to oppositely oscillate the two beam sections can be a lever arrangement, use an eccentric or have a rack-and-pinion setup.

With the system according to the present invention the reaction force is completely compensated for so that the spray beam can be handled relatively easily and displaced with no difficulty over the surface to be treated. Indeed the jet-pump action that partially evacuates the interior of the diffuser or diffusers on the spray beam tends to hold the arrangement against the surface being treated so that even the underside of horizontal surfaces or vertical surfaces can be acted on with great ease. The apparatus according to the present invention operates equally well under water, or in the air.

BRIEF DESCRIPTION OF THE DRAWING

The above and other objects and advantages of the invention will become more readily apparent from the following description, reference being made to the accompanying drawing in which.

SPECIFIC DESCRIPTION

Figure 1:
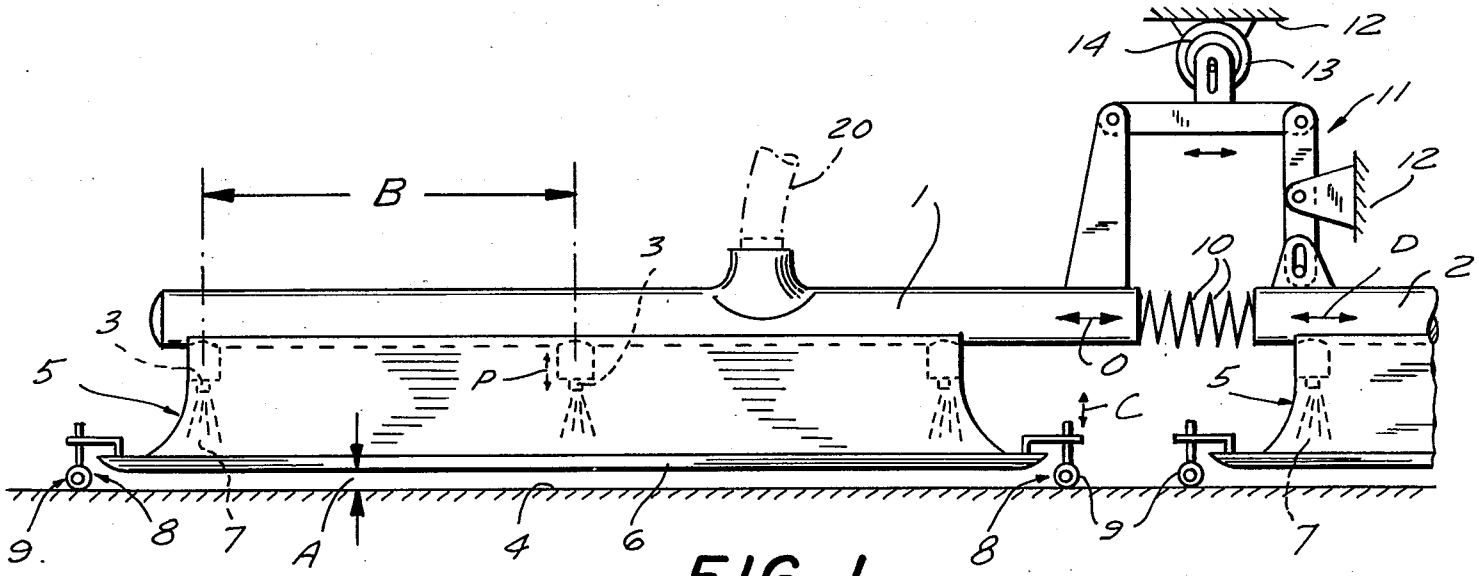
FIG. 1 is a front view of a spray beam according to the present invention.
Figure 2:
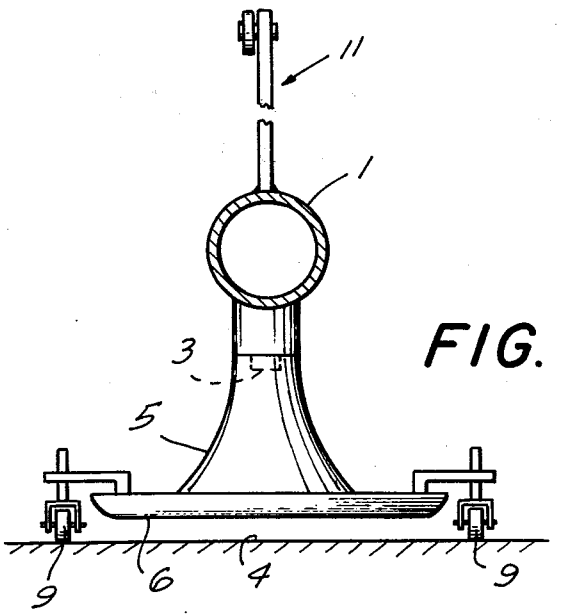
FIG. 2 is a side view of the arrangement of FIG. 1.

FIGS. 1 and 2 show a surface treatment device having a pair of spray beams 1 and 2 each provided with three spray nozzles 3 directed at a flat surface 4 to be treated and displaceable as shown by arrow P on the support perpendicular to the surface. Each beam section 1 and 2 is provided with a respective diffuser 5 having a flange 6 for diverting the sprays 7 issuing from nozzles 3 between the flange 6 and the surface 4 as indicated by arrows 8. A base 20 supplies water under pressure to the nozzles 3.

Figure 4:
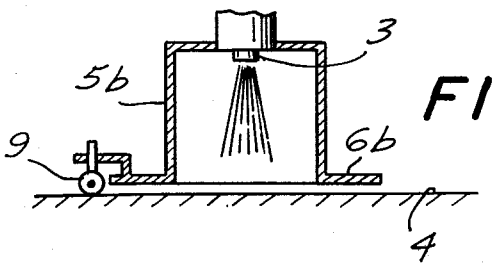
FIGS. 3–6 show various nozzle arrangements for the spray beam according to this invention.
Figure 3:
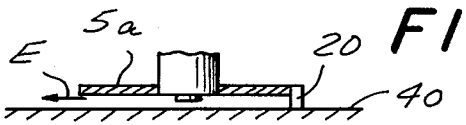
Figure 6:
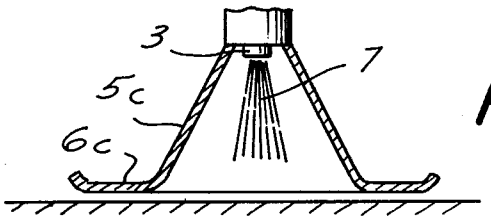

The diffuser and diverting flange can be formed as a flat plate such as shown at *5a* in FIG. 3. A cylindrical diffuser such as shown at *5b* in FIG. 4 with the nozzle mounted at the base of the cylinder may also be used. This cylindrical diffuser *5b* has a lip *6b* constituting the diverting flange and carrying rollers 9 that maintain the diverting flange *6b* at a predetermined spacing A (see FIG. 1) from the surface 4. A frustoconical diffuser *5c* with a lip *6c* constituting the diverting flange may also be provided as shown in FIG. 6.

Figure 5:
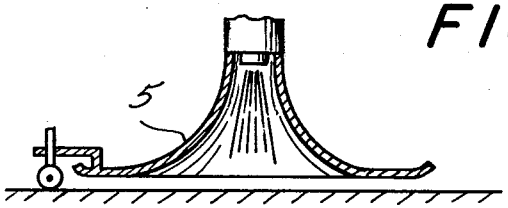

The arrangement of FIGS. 1, 2, and 5 has a diffuser 5 of hyperbolic cross section so that the spray 7 will tend to follow the inner surface of the diffuser 5 outwardly according to the Coanda effect. The rollers 9 are adjustable to vary the spacing A as is shown by arrow C, and may be replaced by casters or simply sliders. The nozzles 3 are spaced apart by a distance B equal to half of the longitudinal length of the longitudinally elongated diffusers 5 shown in cross section in FIG. 5 and in end view in FIG. 2.

The beam sections 1 and 2 are connected together by a compression spring 10 and by a lever arrangement 11 anchored on the support 12 of the apparatus and oscillated back and forth by means of a motor 13 having a crank 14 coupled to the lever arrangement 11. Thus the two beam sections 1 and 2 reciprocate as indicated by arrows D, greatly enhancing the cleaning effect.

Figure 8:
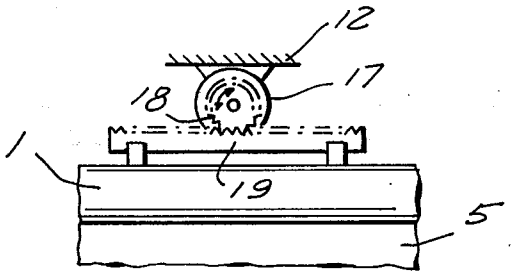
FIGS. 7 and 8 are detail views of arrangements for oscillating the spray-beam sections of the apparatus according to the present invention.
Figure 7:
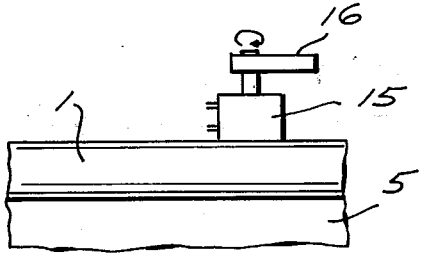

FIG. 7 shows how a small motor 15 with an eccentric weight 16 carried on the beam section 1 may serve to similarly oscillate beam section 1, this time, however, with the beam section 1 describing small circles. A motor 17 as indicated in FIG. 8 may be carried on the support 12 and has a pinion 18 meshing with a rack 19 carried on the beam section 1. Alternate oscillation of the pinion 18 will displace the beam section 1 back and forth in its longitudinal direction.

In accordance with the present invention the oscillations, whether they be in or transverse to the longitudinal direction of the beams 1 and 2 have a frequency between 1 hz and 1000 hz, a frequency of between 20 hz and 30 hz, preferably 25 hz, being found most effective for good scrubbing of the surface 4.

It is also possible to provide as shown in FIG. 3 a skirt 20 which seals against the surface 4 and forces all of the liquid out in the direction of arrow E. On the open side of the diffuser, therefore, the cleaning effect is increased.

I claim:

1. An apparatus for treating a surface with a liquid, said apparatus comprising:
   - a support displaceable over said surface,
   - a spray beam on said support,
   - a plurality of nozzles on said beam directed at said surface,
   - means for supplying said liquid to said nozzles and directing a stream of said liquid from each nozzle toward said surface,
   - means on said support for maintaining said nozzles a predetermined distance from said surface,
   - a diffuser surrounding at least one of said nozzles and having a deflector surface for diverting the respective stream of said liquid to flow in a direction generally parallel to said surface, and
   - means for adjusting the distance of said nozzles from said surface independently of the distance of said diffuser therefrom.

2. The apparatus defined in claim 1 wherein said diffuser is a flat plate lying generally parallel to said surface.

3. The apparatus defined in claim 1 wherein each of said diffusers is generally cylindrical and has a base provided with the respective nozzle and formed with an outwardly extending flange constituting said deflector.

4. The apparatus defined in claim 1 wherein said diffuser is generally funnel-shaped and has an outwardly extending flange constituting said diffuser.

5. The apparatus defined in claim 4 wherein said diffuser is of hyperbolic cross section.

6. The apparatus defined in claim 1, further comprising means engageable with said surface for adjusting said predetermined distance.

7. The apparatus defined in claim 6 wherein said means for adjusting includes a rolling element carried on said support and engageable with said surface.

8. The apparatus defined in claim 1 wherein said beam is elongated and said nozzles are equispaced along said beam.

9. The apparatus defined in claim 1 wherein said beam comprises a pair of beam sections and said support includes a spring braced between said sections, said apparatus further comprising means for vibrating said sections.

10. The apparatus defined in claim 9 wherein said sections are elongated and said means for vibrating is effective to longitudinally oscillate said sections.

11. The apparatus defined in claim 10 wherein said sections are oscillated at a frequency of between 1 hz and 1000 hz.

12. The apparatus defined in claim 11 wherein said means for vibrating includes a linkage between said sections.

* * * * *